US008764014B2

(12) United States Patent
Moody

(10) Patent No.: US 8,764,014 B2
(45) Date of Patent: Jul. 1, 2014

(54) METHOD OF DEALING HANDS OF CARDS IN GAMES HAVING A DEALER AND MULTIPLE PLAYERS

(75) Inventor: Ernest W Moody, Las Vegas, NV (US)

(73) Assignee: Ernest Moody Revocable Trust, Las Vegas, NV (US)

( * ) Notice: Subject to any disclaimer, the term of this patent is extended or adjusted under 35 U.S.C. 154(b) by 932 days.

(21) Appl. No.: 12/248,711

(22) Filed: Oct. 9, 2008

(65) Prior Publication Data

US 2009/0166974 A1 Jul. 2, 2009

Related U.S. Application Data

(60) Provisional application No. 60/978,496, filed on Oct. 9, 2007.

(51) Int. Cl.
*A63F 1/00* (2006.01)

(52) U.S. Cl.
USPC ..... 273/292; 273/274; 463/12

(58) Field of Classification Search
USPC ..... 273/292, 274, 309; 463/12
See application file for complete search history.

(56) References Cited

U.S. PATENT DOCUMENTS 3,796,433 A * 3/1974 Fraley et al. ..... 463/12
2005/0020339 A1* 1/2005 Cimring et al. ..... 463/13

* cited by examiner

*Primary Examiner* — Benjamin Layno
(74) *Attorney, Agent, or Firm* — John Edward Roethel

(57) ABSTRACT

The conventional manner of play of Twenty-One is modified by having the two initial dealer cards comprising the dealer's initial hand dealt to the dealer position before any cards are dealt to any of the player positions. After the two initial dealer cards are dealt, a fifty card depleted deck is established comprising the original fifty-two card standard deck less the two cards dealt to the dealer position. The cards for each player position are then dealt from the fifty card depleted deck. After the player has received his final Twenty-One hand, the dealer's final hand is completed, also using the depleted fifty card deck. Winning and losing hands are determined according to the conventional manner of play of Twenty-One.

1 Claim, 1 Drawing Sheet

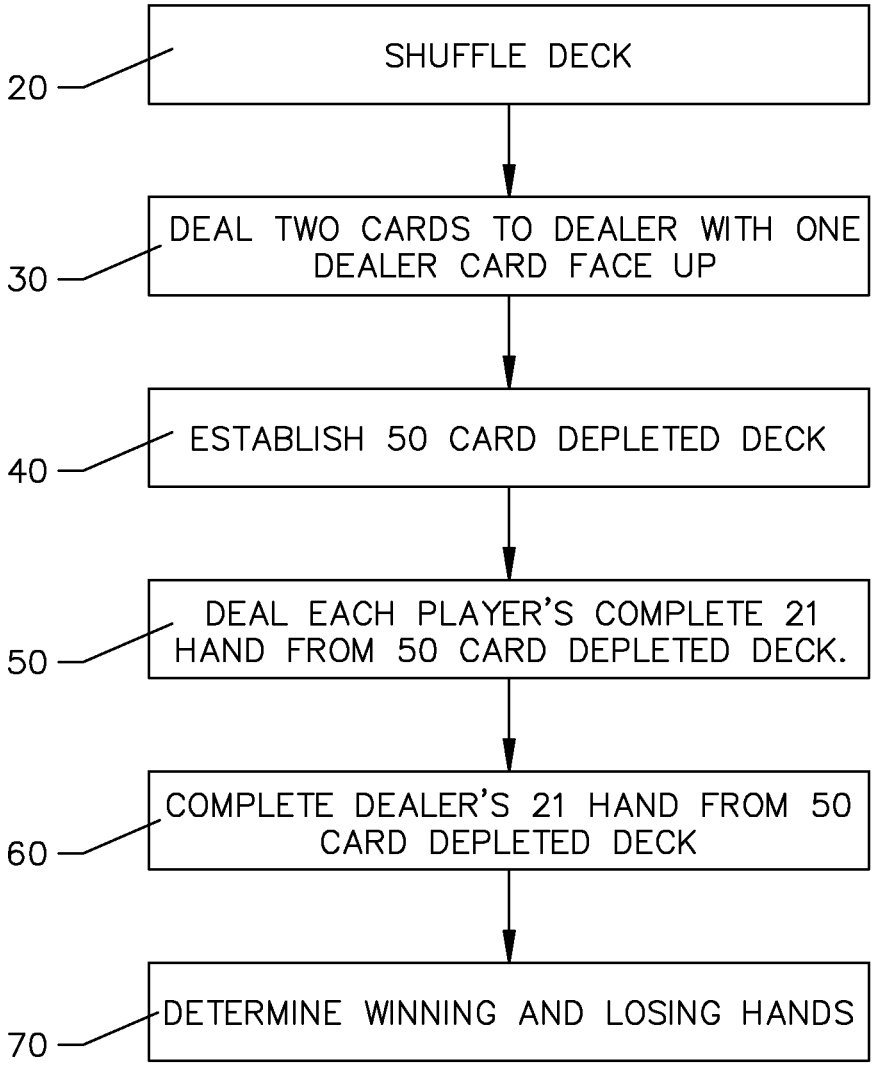
20
SHUFFLE DECK
30
DEAL TWO CARDS TO DEALER WITH ONE DEALER CARD FACE UP
40
ESTABLISH 50 CARD DEPLETED DECK
50
DEAL EACH PLAYER'S COMPLETE 21 HAND FROM 50 CARD DEPLETED DECK.
60
COMPLETE DEALER'S 21 HAND FROM 50 CARD DEPLETED DECK
70
DETERMINE WINNING AND LOSING HANDS

METHOD OF DEALING HANDS OF CARDS IN GAMES HAVING A DEALER AND MULTIPLE PLAYERS

CROSS-REFERENCE TO RELATED APPLICATION

This application is based on and claims the benefit of U.S. Provisional Application Ser. No. 60/978,496, filed Oct. 9, 2007, the disclosure of which is incorporated herein in its entirety.

This invention relates to a method of dealing hands in a card game, and more particularly to a method of dealing hands in a card game having a single dealer and multiple players.

BACKGROUND OF THE INVENTION

There are many casino games in which a hand of cards are dealt to each player and a hand of cards are dealt to a dealer. The general object of these games is for the player to achieve a final hand that beats the dealer's final hand.

For example, in the game of Twenty-One, each player is initially dealt two cards and the dealer is dealt at least one card face up. Depending on the dealing procedure used, the dealer normally is dealt a second card which remains face down to the players until each player has completed the play of his hand. At which time, the dealer's second card is exposed and the dealer completes the play of his hand according to the house rules. Winning and losing outcomes are then determined.

Typically, the dealing procedure for Twenty-One involves the dealer dealing one card to each player starting with the player on the dealer's immediate left. After each player has received his first card, the dealer deals one card to the dealer's hand. A second card is then dealt to each player and the second card is dealt to the dealer's hand. One of the dealer's cards is displayed face up.

The dealer then starts with the player to the dealer's immediate left and asks the player whether he wishes to Hit or Stand. As desired by the player, the dealer continues to deal additional face up cards to that player until the player either Stands or Busts. The dealer then proceeds from left to right around the table until all players have achieved their final Twenty-One hand. The dealer then exposes his second card and completes the dealer's final Twenty-One hand according the Hit or Stand house rules for dealing the dealer's Twenty-One hand. Winning and losing wagers are resolved.

As played in most gaming casinos presently, the conventional manner of play of Twenty-One involves a game of chance between a dealer and one or more players. The object is for the player to achieve a numerical count of his hand closer to 21 than the final numerical count of the hand of the dealer; but if the numerical count of the player's hand goes over 21 then the player loses regardless of the final numerical count of the dealer's hand.

The conventional manner of play of Twenty-One is as follows: One or more standard decks of playing cards are used and each card counts its pip face value (with Jacks, Queens and Kings counting 10), except Aces which have a value of one or eleven as is most beneficial to the count of the hand.

The deck or deck of cards is shuffled and a dealer distributes the cards to each player. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has had the opportunity to take additional cards ("hits"), the dealer then receives his second card.

A player may draw additional cards in order to try and beat the count of the dealer's hand. If the player's numerical count exceeds 21, the player "busts." The player may "stand" on any numerical count of 21 or less. When a player busts, he loses his wager regardless of whether or not the dealer busts when the dealer draws additional cards to his hand.

After all of the players have taken hits or have stood on their hand, the dealer "stands" or "hits" based on pre-established house rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" numerical count. However, in other gaming establishments, the dealer stands on a "soft 17" numerical count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer has busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager up to, but not more than, the amount of the player's initial ante. The dealer deals to the player one additional card and the resulting three card hand establishes the numerical count for the player's hand. The most widely used "Doubling Down" rules permit the player to "double down" only on 10 or 11 counts. Other variations allow players to "double down" on 9, 10 or 11; only on 11; or on any two cards.

Another well-known procedure is "Splitting Pairs." If the player's first two cards are a pair, the player may "split" those cards into two separate hands. His original ante is applied to one of the hands and he makes an additional ante in the same amount for the other hand. The player receives a new second card for each of the split hands. Each of the split hands is then played separately and the player proceeds on each separate hand by standing or taking hits until he has achieved a hand count upon which he wishes to stand or until he busts. However, if the player splits Aces, then the player only receives one extra card on each Ace, unless the extra card is an Ace in which the case the player may again split the pair of Aces.

The player may "double down" on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting."

Another well-known procedure is "Insurance." If the dealer's up card is an Ace, the player may make an additional "Insurance" bet. The insurance bets are made after each player receives his first two cards and the dealer reveals his up card (which must be an Ace for insurance to be available) and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a Blackjack, the player loses on his original ante but wins two-to-one odds on his "insurance" bet. Also if the dealer has a Blackjack, that round of the game is over and all players lose except those who also have Blackjacks, who then tie or "push" with the dealer. If the dealer does not have a Blackjack, the player loses on his "insurance" bet and the round of the game continues.

Another conventional feature that is often offered in Twenty-One games is the "Surrender" option. If the player chooses to Surrender, the player receives back half of his initial wager and folds his hand. This option is usually only available after the player has received his first two cards and before the player has taken any hits on his hand.

As used in this disclosure and the accompanying claims, the terms "conventional Twenty-One" and "the conventional manner of play of Twenty-One" mean the game of Twenty-One as previously described and also includes any of the known variations of the game of Twenty-One.

The present manner of presenting a game of Twenty-One to players is to use a live table game format in which a single dealer position is used in conjunction with up to six or seven player positions. Thus no more than seven players can be accommodated during a typical round of Twenty-One. Even the electronic gaming versions of Twenty-One follow the live gaming table format and limit themselves to no more than seven player positions per dealer position.

There is a need to provide a method of play of a Twenty-One game in which multiple player positions in excess of seven can be accommodated in an electronic gaming environment, preferably using a single dealer position. This will permit a higher volume of play per each round of Twenty-One and increase game revenue to the gaming establishment.

When a single deck of playing cards is used, the number of player positions is limited by the fact that there are only fifty-two cards in the deck. There simply would not be enough cards in the deck to accommodate twenty or more player positions playing against a single dealer position.

The present invention can accommodate theoretically an unlimited number of player positions playing against a single dealer position.

SUMMARY OF THE INVENTION

The present invention modifies the conventional manner of play of Twenty-One by having the two initial dealer cards comprising the dealer's initial hand dealt to the dealer position before any cards are dealt to any of the player positions. After the two initial dealer cards are dealt, a fifty card depleted deck is established comprising the original fifty-two card standard deck less the two cards dealt to the dealer position. The cards for each player position are then dealt from the fifty card depleted deck. After the player has received his final Twenty-One hand, the dealer's final hand is completed, also using the depleted fifty card deck. Winning and losing hands are determined according to the conventional manner of play of Twenty-One.

Alternatively, each player and the dealer use completely separate fifty-two card decks.

BRIEF DESCRIPTION OF THE DRAWINGS

FIG. 1 shows a flow chart of the method of the present invention.

DETAILED DESCRIPTION OF THE PREFERRED EMBODIMENTS

The present invention modifies the conventional manner of play of Twenty-One by having the two initial dealer cards comprising the dealer's initial hand dealt to the dealer position before any cards are dealt to any of the player positions. In order to accommodate a virtually unlimited number of player positions, the method of play is practiced on an electronic gaming system using either a live dealer or an electronic representation of a dealer. A plurality of player positions are associated with the dealer position in any suitable manner.

For example, the dealer position may be displayed on a large video screen display electronically connected to a main computer at a suitable location in a gaming establishment. A plurality of electronic player positions can be provided with each player position having its own video screen monitor and electronically connected to the main computer. Each player position includes the apparatus necessary for the player to make wagers and to play out the player's cards that are displayed to each player on his monitor. The main computer includes the software used to deal the cards, determine winning and losing hands and effect payouts during the play of the Twenty-One game.

FIG. 1 shows a flow chart of the method of play. A standard deck of fifty-two playing cards is used. Prior to the start of each round of play of the Twenty-One game, the deck is electronically shuffled 20 to provide an appropriate randomness to the deck of cards.

Each player wishing to participate in the round of play of the Twenty-One game makes a wager by using the wagering input apparatus at the player's position. The wagering may use actual physical casino chips or may be conducted electronically using the typical wagering devices associated with electronic multi-player gaming machines. After all players who wish to play have made a wager, the dealing of the cards begins.

Two cards from the fifty-two card deck are randomly selected and displayed at the dealer location 30, preferably on the video screen display associated with the dealer location. It would also be appropriate to show the dealer's two initial cards on each player monitor so that a player does not need to be within eyesight of the dealer's video screen display. One of the dealer's initial two cards is displayed face up as is conventional in Twenty-One.

After the two initial dealer cards are dealt, a fifty card depleted deck is established 40 comprising the original fifty-two card standard deck less the two cards comprising the dealer's initial hand and dealt to the dealer position. This fifty card depleted deck is used repeatedly during the remainder of play of the Twenty-One game of the present invention.

The cards for each player position are then dealt from this fifty card depleted deck 50. Each player receives his initial two cards from his separate fifty card depleted deck. Each player then decides whether to Stand or Hit as is conventional in the method of play of Twenty-One. If the player takes Hits and receives additional cards, these cards are dealt from that player's fifty card depleted deck.

Unlike traditional Twenty-One in which each player must act in turn as the dealer goes around the table, in the method of play of the present invention, each player may act independently from each other player since each player receives his cards from his own separate fifty card depleted deck. This allows a virtually unlimited number of players to participate against a single dealer's hand with all players acting generally simultaneously. The gaming establishment could set a reasonable time limit, say fifteen seconds, for each player to complete the player of his hand. Thus, a game of Twenty-One having one hundred players could be played in less time than it would take for a live table game of Twenty-One to be played having six or seven players.

After each player has completed his play and has received his final Twenty-One hand, the dealer's final hand is completed, also using the same depleted fifty card deck 60. The dealer's hand is played out according to the house rules for whether the dealer Stands or Hits according to the conventional manner of play of Twenty-One.

Winning and losing hands are determined according to the conventional manner of play of Twenty-One 60. Each player who has a winning hand receives a payout based on the amount of his wager and each player with a losing hand loses his wager to the gaming establishment.

Alternatively, each player and the dealer uses separate fifty-two card decks. In this version, it is possible for a player and the dealer to have the same cards since each player and the dealer is using his own fifty-two card deck. However, this version simplifies the card tracking required by the computer software since this version eliminates the need to create the fifty card depleted deck that would be used to deal cards to each player and to complete each player and the dealer's final hands.

Using the dealing procedure of the present invention, it is possible to allow a large number of players to participate in a Twenty-One game tournament.

Each player in the tournament would make a wager or pay an entry fee to participate in the tournament. Or the gaming establishment could provide the player with an entry into the tournament as a reward for previous gaming play or as part of a promotion. Each player would play a series of Twenty-One hands against the dealer with the players having the highest scores receiving cash or other prize awards.

The tournament would comprise a series of Twenty-One hands, say fifteen hands. The tournament could be conducted by having the having the dealer's fifteen hands being preset in the programming of the computer controls so that each player would be playing against the same dealer's fifteen hands. Alternatively, each player would also have the same preset fifteen hands as the other players and would play against the dealer's fifteen preset hands. This would allow player skill to determine the final ranking of the players.

Another way to conduct the tournament would be to provide each player with the same preset fifteen starting hands as the other players and each player would play against the dealer's fifteen preset hands. Any additional cards drawn by each player would be randomly selected from the depleted deck so that both skill and luck would determine the final player rankings.

These tournament methods would allow hundreds of players to participate in the tournament. The tournament could be a single round of play, or the tournament could have levels of play with a cut coming after each level. For example, a tournament could start with 500 players. The top 250 could go to the next level, the top 100 to the third level with the top 20 playing in the final level. Any suitable cut points and suitable number of levels could be used.

While the invention has been illustrated with respect to several specific embodiments thereof, these embodiments should be considered as illustrative rather than limiting. Various modifications and additions may be made and will be apparent to those skilled in the art.

What is claimed is:

1. A method of dealing hands in a Twenty-One game having a single dealer and multiple players and using at least one standard deck of fifty-two cards, comprising a) dealing two initial dealer cards comprising a dealer's hand from the standard deck of fifty-two cards before any cards are dealt to any of the players;

b) creating a fifty card depleted deck comprising the fifty-two card standard deck less the two cards comprising the dealer's hand;

c) dealing two cards comprising a player hand for each player from the fifty card depleted deck, a separate fifty card depleted deck being used for each player;

d) each player playing out his player hand according to the conventional manner of play of Twenty-One;

e) using the fifty card depleted deck, playing out the dealer hand according to the conventional manner of play of Twenty-One, the dealer hand also using a separate fifty card depleted deck; and f) determining winning and losing hands according to the conventional manner of play of Twenty-One.

* * * * *